United States Patent [19]

Littwin et al.

[11] 4,362,967

[45] Dec. 7, 1982

[54] GAS DISCHARGE DISPLAY DEVICE WITH AT LEAST ONE SPACING FRAME WHICH LIMITS THE POST-ACCELERATION CHAMBER

[75] Inventors: Burkhard Littwin, Hohenschaeftlarn; Wilhelm Huber, Goldach, both of Fed. Rep. of Germany

[73] Assignee: Siemens Aktiengesellschaft, Berlin & Munich, Fed. Rep. of Germany

[21] Appl. No.: 207,696

[22] Filed: Nov. 17, 1980

[30] Foreign Application Priority Data

Dec. 28, 1979 [DE] Fed. Rep. of Germany ..... 2952528

[51] Int. Cl.[3] ..... H01J 17/49

[52] U.S. Cl. ..... 313/493; 313/485

[58] Field of Search ..... 313/217, 493, 485

[56] References Cited

U.S. PATENT DOCUMENTS 4,112,329 9/1978 Veith ..... 313/493

*Primary Examiner*—Alfred E. Smith

*Assistant Examiner*—T. N. Grigsby

*Attorney, Agent, or Firm*—Hill, Van Santen, Steadman, Chiara & Simpson

[57] ABSTRACT

A gas discharge display device has a discharge chamber and a post-acceleration chamber which are separated by a perforated control disc having line and column conductors thereon. The post-acceleration chamber is limited at its lateral boundary by at least one spacing frame which leaves the post-acceleration chamber support-free in its active volume. The inner boundary of the lateral spacing frame substantially coincides with the outer boundary of an active luminescent screen surface which limits one side of the post-acceleration chamber, and the frame has a width such that the inner frame boundary is free of sealing material and which further maintains a separation between the outer edge regions of the potential layers on the opposite sides of the post-acceleration chamber. A high post-acceleration voltage can thus be employed in the post-acceleration chamber without producing arcing.

14 Claims, 6 Drawing Figures

GAS DISCHARGE DISPLAY DEVICE WITH AT LEAST ONE SPACING FRAME WHICH LIMITS THE POST-ACCELERATION CHAMBER

BACKGROUND OF THE INVENTION

1. Field of the Invention

The present invention relates to gas discharge display devices having a gas filled sealed chamber which is divided by a control disc into a gas discharge chamber and a post-acceleration chamber, and in particular to such a gas discharge display device having a spacing frame for the post-acceleration chamber which allows use of high post-acceleration voltages without arcing.

2. Description of the Prior Art

Gas discharge display devices are known in the art which consist of a gas filled chamber which is terminated in gas-tight fashion on one side by a front plate and on the opposite side by a rear plate and which is subdivided by a control disc parallel to the front and back plates into a gas discharge chamber on the cathode side and a post-acceleration chamber on the anode side are known in the art. The control disc for such devices has electrode paths which are separately driveable which are disposed on one side of the disc as parallel row conductors and on the opposite side as column conductors, which together form a matrix with the disc being perforated at the intersection points of the rows and columns for permitting controlled plasma flow therethrough. The interior of the front plate has a luminescent screen provided with an anode layer and the interior of the rear plate has one or more cathodes which are insulated with respect to each other. A spacing frame is provided between the control disc and the luminescent screen, as well as between the control disc and the cathode(s).

A gas discharge display device of the type described above having a cathode consisting of parallel cathode strips which are insulated from one another and are separately driveable is disclosed in German OS No. 26 43 915, corresponding to U.S. Pat. No. 4,130,778. The division of the cathode into separated cathode strips which are insulated from one another is an improvement over a similar device employing a plate cathode which is known from German OS No. 24 12 869 corresponding to U.S. Pat. No. 3,956,667. This device is utilized for picture reproduction on so-called flat screens as well as in gas discharge displays.

Display devices of this type function according to the principle of the spatial separation of electron generation and electron acceleration. As stated above, the device is divided into two chambers which are connected with one another via a conductor matrix formed on a perforated control disc by intersecting lines and columns of conductors. The chamber between the cathode or cathodes at the rear plate and the line conductors, which serve as auxiliary anodes, on the conductor matrix is the chamber wherein gas discharge takes place. The other chamber is the post-acceleration chamber which is between the column conductor side of the control disc and a flat annode which may be a luminescent screen electrode. By selectively driving one of the auxiliary anodes, a wedge-shaped gas discharge volume arises between the cathode and the auxiliary annode over the entire line length. By simultaneously driving one of the strip-shaped matrix column electrodes, plasma electrons which are generated in the gas discharge area are drawn through the perforation at the intersection point of the line and column conductors into the post-acceleration chamber and are accelerated to the anode. At the point of impact on the screen, a light point arises on a luminescent material layer which is deposited on the anode which corresponds to the image of the intersection point of the matrix which was selectively driven. The column and line conductors on the control disc are selectively driven according to a time-related course and intensity whereby symbols and pictures can be presented on the luminescent screen.

A further gas discharge display device having spacing elements is known from German OS No. 27 50 587 wherein ridges having a constant wall thickness are provided between the control disc and the post-acceleration anode, those ridges extending in the plane of the control disc past which the control disc perforations are guided and which run in segments alternatingly parallel and diagonally to the conductors which are facing the ridges.

For maintenance of spacing in a gas discharge display device between the control disc and the luminescent screen, it has been proposed in German patent application No. P28 55 108.8, corresponding to U.S. co-pending application Ser. No. 096,920 to arrange several perforated glass foils adjacent to each other which each have metallized surface layers. The metal layers carry floating potentials and thereby homogenize the acceleration field.

In each of the devices described above, it is a problem to make use of a high post-acceleration voltage in the post-acceleration chamber without bringing about arcing or flash over. Such arcing generally occurs between supports which may be present between the anode and the control disc in order to maintain a proper spacing therebetween, or may occur between the control disc and the material used to seal the post-acceleration chamber in a gas tight fashion.

SUMMARY OF THE INVENTION

It is an object of the present invention to provide a gas discharge display device having a gas tight chamber divided into a gas discharge chamber and a post-acceleration chamber by a perforated control disc which makes use of a high post-acceleration voltage in the post-acceleration chamber without the occurrence of arcing or flash over.

The above object is inventively achieved in a gas discharge device having at least one spacing frame which maintains a specified spacing between the control disc and the anode in an otherwise support-free manner and which limits the lateral boundary of the post-acceleration chamber. The inner boundary of the spacing frame generally coincides with the outer boundary of the active luminescent screen surface on the anode and has a width such that the inner frame boundary remains free of sealing materials utilized to achieve a gas-tight bond between the frame and the anode and the frame and the control disc. The spacing frame further separates the outer edge regions of the potential layers which limit the post-acceleration chamber.

The spacing frame is preferably surrounded by a second outer spacing frame which serves for the air tight sealing of the post-acceleration chamber. The spacing frames may be comprised of glass which has a thermal coefficient of expansion which is matched to that of the luminescent screen glass.

The above inventive gas discharge display device has the advantage that a high post-acceleration voltage can be used in the post-acceleration chamber without bringing about arcing or flash overs. Because such arcing generally occurs at insulators in the vacuum, at significantly lower field strengths in comparison with the field strength in the vacuum, a support-free post-acceleration chamber is desired so that the critical region in which insulator arcing can occur is limited to the lateral boundary of the post-acceleration chamber.

DESCRIPTION OF THE PREFERRED EMBODIMENTS

Figure 1:
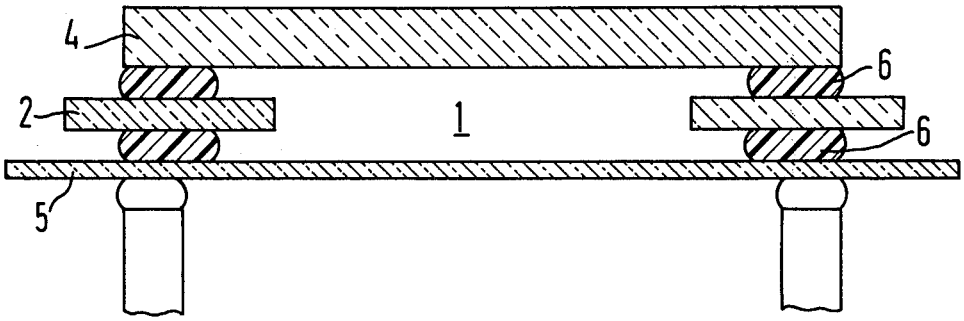
FIG. 1 is a sectional view of a portion of a gas discharge device constructed in accordance with the principles of the present invention with a lateral spacing frame surrounding the post-acceleration chamber.

A gas discharge display device is shown schematically in FIG. 1 with portions thereof not pertinent to the present invention being omitted. The portion of the device shown in FIG. 1 consists of a post-acceleration chamber 1 having an overly wide spacing frame 2 disposed between a luminescent screen 4 and a control disc 5 for increasing the high voltage stability of the device. The post-acceleration chamber 1 is maintained air tight by adhesive seams 6 between the spacing frame 2 and the screen 4, as well as between the frame 2 and the control disc 5. The spacing frame 2 projects laterally over the adhesive seams 6. The high voltage stability is measured by the maximum voltage which can be achieved before arcing occurs. The high voltage stability of the structure shown in FIG. 1 for a one millimeter long acceleration path is increased from 2.5 kV to 6 kV when a spacing frame 2 is utilized having a thickness of 0.8 millimeters and which laterally projects over the adhesive seam 6 by approximately 5 millimeters.

Figure 2:
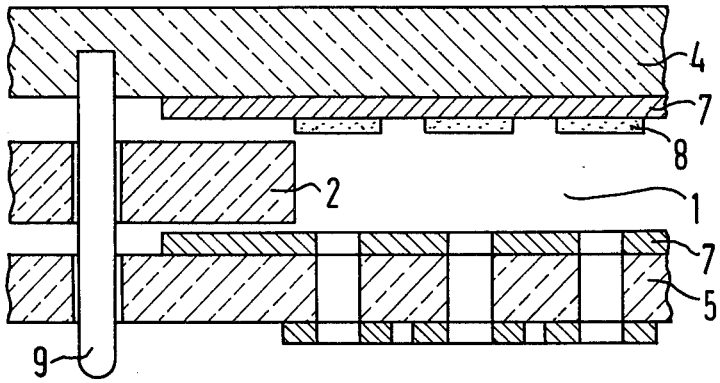
FIG. 2 is an enlarged sectional view of a portion of the inner boundary of an inventive spacing frame for a gas discharge display device.

A more detailed embodiment of the structure shown in FIG. 1 is shown in FIG. 2 with elements corresponding to those in FIG. 1 identically numbered. As shown in FIG. 2, the spacing frame 2 extends close to the active portion of the luminescent screen 4 which is provided with a potential layer 7 and a luminescent material layer 8. The control disc 5 also carries a potential layer 7 and the two potential layers 7 which limit the post-acceleration chamber 1 are separated from each other at their edge regions by the inner part of the spacing frame 2. The inner edge of the spacing frame 2 is free of sealing material such as, for example, glass solder. That portion of the spacing frame 2 which is directed toward the outer boundary of the gas discharge display device serves for air tight sealing of the chamber.

Figure 3:
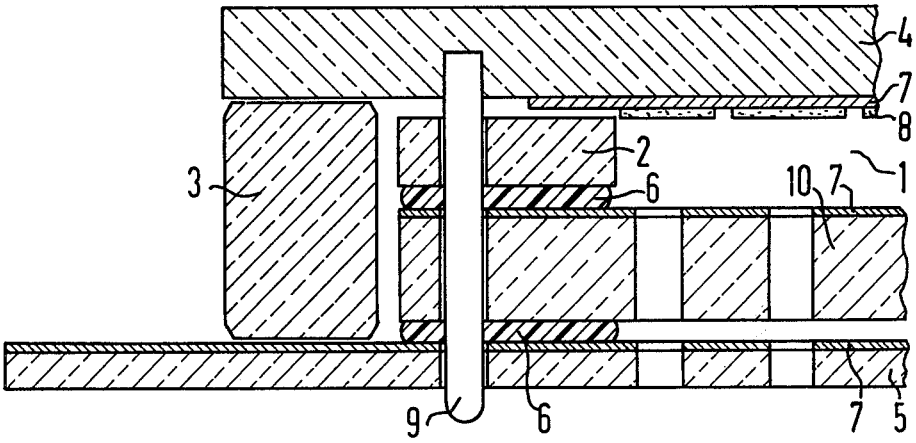
FIG. 3 is a sectional view of a further embodiment of the device shown in FIG. 2 with an outer spacing frame added.
Figure 4:
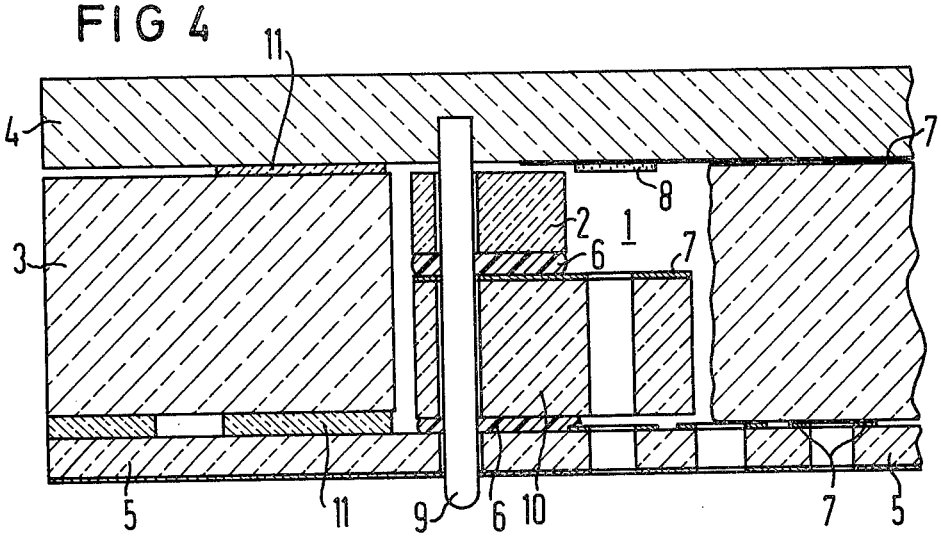
FIG. 4 is a sectional view of a further embodiment of the spacing frame shown in FIG. 3.
Figure 5:
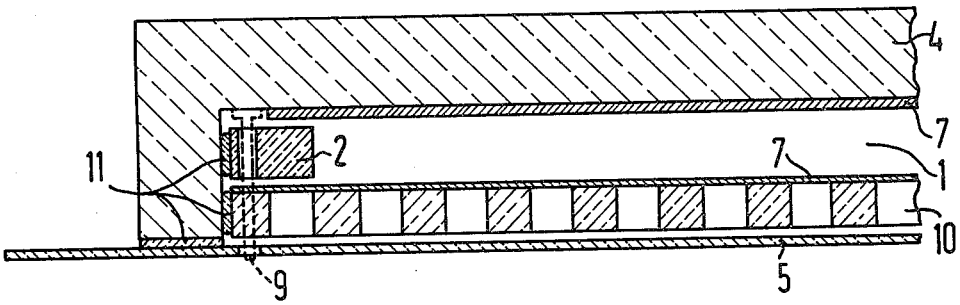
FIG. 5 is a sectional view of a schematic representation of the structure of a post-acceleration chamber for a luminescent screen glass with an integrated spacing frame.

Optimal clearance during the construction of such gas discharge display devices is achieved when the spacing frame is divided into an inner and outer frame corresponding to the above two functions of separating and sealing. The luminescent screen 4 may have a number of adjusting pins 9 connected thereto which serve to align the luminescent grid 8, the photoform plate and the control disc 5 during the glass soldering process. FIGS. 3 through 5 represent different embodiments of this basic structure.

In FIG. 3, a second outer spacing frame 3 is shown which has a height which is greater than the height of the post-acceleration chamber 1 and serves to seal additional control grids in air tight fashion without additional glass solder seams. In the construction of the outer spacing frame 3, presintered glass solder rods may be utilized which are shaped as needed during the glass soldering process by the plastic deformation of the glass solder in contact therewith.

If, however, an especially stable glass solder seam is needed, the outer spacing frame 3 may be comprised of glass in order that the thickness of the glass soldering seam be as small as possible. Other similar variations to the structure shown in FIG. 3 in order to meet varying stability requirements can be undertaken without departing from the inventive concept herein.

In the embodiment of FIG. 3, an additional control grid 10, which has a potential layer 7, is disposed between the screen 4 and the control disc 5, each of which also have a potential layer 7, in the post-acceleration chamber 1.

Assembly of the device shown in FIG. 3 is as follows. The control grid 10 is first brought into the correct position relative to the control disc 5 and is fixed in that position with a temperature adhesive at several points, such as the adhesive seams 6. The inner spacing frame 2 is then also fixed in relative position on the control grid 10 with several drops of a high-temperature adhesive. For air tight sealing of the structure, four pre-sintered glass solder rods each having a width of approximately 10 millimeters and a thickness of 2.5 millimeters to 3 millimeters are placed around the outside of the inner spacing frame 2. The entire structure is then subjected to a tempering process. The glass solder, which is initially present in access, flows against the luminescent screen 4 as the screen is lowered to a level determined by the control grid 10 and the inner spacing frame 2 and fills any gaps which may still remain and in this manner generates a close bond between the control disc 5 and the luminescent screen 4. The adjustment pins 9, as described above, facilitate alignment of all parts.

As shown in the embodiment of FIG. 4, two spacing frames may be utilized. The inner spacing frame 2 limits the post-acceleration chamber 1 between the luminescent screen 4, which has a potential layer 7 and a luminescent material grid 8, and the control grid 10, which is also provided with a potential layer 7. The control grid 10 is disposed on the control disc 5, which also has a potential layer 7 in the form of column conductors. The spacing frame 2, the control grid 10 and the control disc 5 are adjusted as to position relative to each other by the pins 9 and are fixed in place by the adhesive seams 6 which may be a high-temperature adhesive. The outer spacing frame 3 is comprised of two opposing sides of glass strips which are coated with glass solder 11 and two further opposing sides consisting of glass solder. It is preferable to use the glass strips where the control disc 5 extends relatively far out of the display device and must be supported.

A luminescent screen glass with an integrated spacing frame for the post-acceleration chamber 1 is shown in FIG. 5. The screen 4 has sides integrally formed thereon and a potential layer 7 so that the separate outer spacing frame 3 is not necessary and its function is accomplished by the vertical walls of the screen 4. The inner spacing frame 2, which prevents high voltage arcing, and which projects into the interior of the post-acceleration chamber 1 in the form of glass strips, is directly fastened to the sides of the screen 4 by, for example, glass solder 11. The spacing frame 2 is attached to the screen 4 in the embodiment of FIG. 5 after all of the layers for the functioning of the screen 4 have been applied to the screen glass. The adjusting pin 9, also applied to the screen 4, again serves to adjust the relative positions of the control disc 5, the control electrode 10 (which is also provided with a potential layer 7) and the spacing frame 2.

Figure 6:
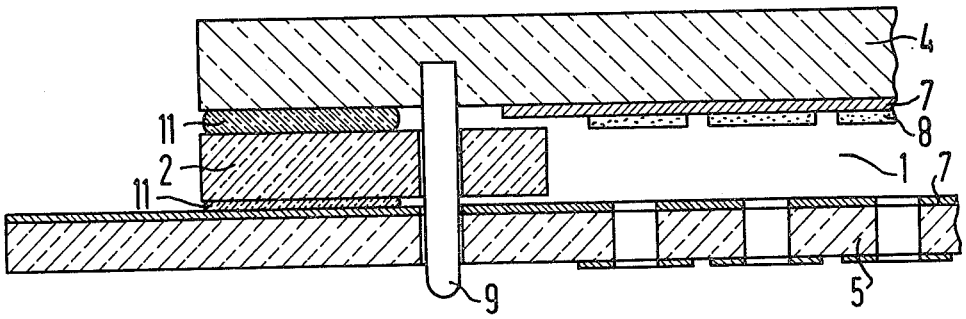
FIG. 6 is a sectional view of a schematic presentation of an inner and outer spacing frame for a gas discharge display device combined in one unit.

A further embodiment is shown in FIG. 6 wherein the inner and outer spacing frames are combined in a single unitary structure referenced at 2. Other elements common to the embodiments previously discussed are referenced with identical numerals. Again, the adjusting pin 9 extends from the luminescent screen 4 through the spacing frame 2 and the control disc 5 to fix the relative positions of those elements. The spacing frame 2 is attached in air tight fashion with the control disc 5 and the luminescent screen 4 by glass solder layers 11.

Although modifications and changes may be suggested by those skilled in the art it is the intention of the inventors to embody within the patent warranted hereon all changes and modifications as reasonably and properly come within the scope of their contribution to the art.

We claim as our invention:

1. In a gas discharge display device having a gas-filled, gas-tight space, said space defined by spaced parallel front and back plates, said device having a control disc disposed in said gas-filled space parallel to said front and back plates dividing said gas-filled space into a gas discharge chamber between said back plate and said control disc and a post-acceleration space between said front plate and said control disc, said control disc having a plurality of row conductors on one side thereof and a plurality of column conductors on an opposite side thereof and being perforated at points of intersection of said row and column conductors, said front plate having a luminescent screen thereon with an anode layer and said back plate having at least one cathode, the improvement of:

at least one spacing frame surrounding said post-acceleration chamber and defining a lateral boundary thereof at an interior of said spacing frame, said interior of said spacing frame being substantially coincident with the boundary of an active portion of said luminescent screen, said spacing frame being attached by a sealing material to said control disc and said back plate in an air tight fashion, and said spacing frame having a width such that said sealing material when applied externally does not penetrate said post-acceleration chamber, said spacing frame further separating portions of said anode layer on said front plate and portions of said conductors on said control disc at edge regions of said post-acceleration chamber adjacent to said spacing frame.

2. The improvement of claim 1 further comprising an outer spacing frame surrounding said spacing frame for sealing said post-acceleration chamber in air tight fashion.

3. The improvement of claim 1 wherein said spacing frame is comprised of glass.

4. The improvement of claim 3 wherein said glass comprising said spacing frame has a thermal coefficient of expansion which is matched to the thermal coefficient of expansion of said luminescent screen.

5. The improvement of claim 1 wherein said spacing frame is comprised of connected glass strips.

6. The improvement of claim 1 wherein said spacing frame is maintained in position by a high-temperature adhesive applied between said frame and said back plate and said frame and said control disc.

7. The improvement of claim 2 wherein said outer spacing frame is comprised of a plastically deformable material for deforming when subjected to a selected temperature for forming an air tight bond with said control disc and said back plate.

8. The improvement of claim 2 wherein said outer spacing frame is comprised of pre-sintered glass solder strips.

9. The improvement of claim 2 wherein at least a portion of said outer spacing frame is comprised of glass strips.

10. The improvement of claim 1 wherein said gas discharge device further comprises at least one control grid disposed between said control disc and said front plate and wherein said spacing frame is disposed between said control grid and said front plate, and wherein said outer spacing frame surrounds said spacing frame and said control grid.

11. The improvement of claim 9 wherein said portion of said outer spacing frame which is comprised of glass forms an integral unit with a portion of said spacing frame adjacent to said glass portion of said outer spacing frame.

12. The improvement of claim 2 wherein each of said outer spacing frame and said spacing frame are of one-piece construction.

13. The improvement of claim 2 wherein said outer spacing frame and said spacing frame are combined in an integrated one-piece unit.

14. The improvement of claim 1 further comprising a plurality of adjusting pins carried on said back plate and extending through respective apertures in said spacing frame and said control disc for aligning said spacing frame and said control disc.

* * * * *